US007331774B2

(12) United States Patent
Ueda et al.

(10) Patent No.: US 7,331,774 B2
(45) Date of Patent: Feb. 19, 2008

(54) BACK PRESSURE CONTROL MECHANISM OF ORBITING SCROLL IN SCROLL COMPRESSOR

(75) Inventors: Kenshi Ueda, Kawasaki (JP); Naoya Morozumi, Kawasaki (JP)

(73) Assignee: Fujitsu General Limited, Kawasaki-Shi, Kanagawa-Ken (JP)

( * ) Notice: Subject to any disclaimer, the term of this patent is extended or adjusted under 35 U.S.C. 154(b) by 0 days.

(21) Appl. No.: 11/435,875

(22) Filed: May 18, 2006

(65) Prior Publication Data

US 2006/0263225 A1 Nov. 23, 2006

(30) Foreign Application Priority Data

May 20, 2005 (JP) ..... 2005-147700

(51) Int. Cl.
*F03C 2/00* (2006.01)
*F04C 2/00* (2006.01)

(52) U.S. Cl. ..... 418/55.5; 418/55.1; 418/55.4; 418/57; 418/94; 418/104

(58) Field of Classification Search ..... 418/55.1–55.6, 418/57, 94, 104
See application file for complete search history.

(56) References Cited

U.S. PATENT DOCUMENTS 6,389,837 B1 * 5/2002 Morozumi ..... 418/55.5
6,561,776 B2 * 5/2003 Morozumi ..... 418/55.5
6,679,690 B2 * 1/2004 Fushiki et al. ..... 418/55.5
6,746,215 B2 * 6/2004 Tani et al. ..... 418/55.6

FOREIGN PATENT DOCUMENTS

JP 2000161254 A * 6/2000

* cited by examiner

*Primary Examiner*—Theresa Trieu
(74) *Attorney, Agent, or Firm*—Manabu Kanesaka

(57) ABSTRACT

There is provided, at a low cost, a small-size and lightweight scroll compressor capable of preventing a decrease in compression efficiency by utilizing a medium pressure between a suction pressure and a discharge pressure as a back pressure. An independent minute gap in the axial direction is provided between a main frame 3 and a thrust ring 8. This minute gap is used as a second back pressure chamber C2, and the medium pressure between the suction pressure and the discharge pressure is introduced into the second back pressure chamber C2.

3 Claims, 6 Drawing Sheets

BACK PRESSURE CONTROL MECHANISM OF ORBITING SCROLL IN SCROLL COMPRESSOR

TECHNICAL FIELD

The present invention relates to a scroll compressor used for compressing a refrigerant, for example, in a refrigeration cycle. More particularly, it relates to a scroll compressor in which a decrease in compression efficiency is prevented by applying a back pressure to the back surface of the end plate of an orbiting scroll.

BACKGROUND ART

Most of the compressors used for a refrigerant cycle have a compression section and a motor chamber in a closed vessel, and the compression section is driven via the rotary drive shaft of a motor. The compression section introduces a low-pressure refrigerant into a closed working chamber formed by engaging scroll wraps erected on the end plates of a fixed scroll and an orbiting scroll with each other, and compresses the refrigerant to a high-pressure refrigerant by decreasing the closed volume of the closed working chamber.

When the refrigerant is compressed in the closed working chamber, the pressure in the working chamber is increased, so that a force that separates the orbiting scroll from the fixed scroll acts. When the orbiting scroll is pushed back downward, a minute gap is formed between the orbiting scroll and the fixed scroll, and therefore the refrigerant leaks out through this gap, which may decrease the compression efficiency.

Accordingly, there has been proposed a configuration in which to prevent the orbiting scroll from separating, some of the discharge pressure of the closed working chamber is led to the back surface of the end plate of the orbiting scroll and is utilized as a back pressure. According to this configuration, the orbiting scroll can be pressed against the fixed scroll side.

However, in the case where the orbiting scroll is pressed by utilizing only the high discharge pressure, under an operating condition that the discharge pressure is higher than the rated pressure, the pressing force of orbiting scroll is too high, and hence the performance and the reliability decrease. Inversely, under an operating condition that the discharge pressure is lower than the rated pressure, the pressing force is too low, so that the orbiting scroll is liable to separate.

To solve this problem, for example, as described in Patent Document 1 (Japanese Patent Application Publication No. 2000-161254), a method has been proposed in which a central portion of the back surface of the end plate of the orbiting scroll is pressed by the discharge pressure, and further the outer periphery thereof is pressed by a medium pressure between the discharge pressure and the suction pressure. According to this method, even if the discharge pressure is higher or lower than the rated pressure, an excessive increase or decrease in pressing force can be eased.

However, the conventional scroll compressor has the problems as described below. In the configuration described in Patent Document 1, the inside of the small-diameter portion of a thrust ring is also used as a main guide bearing, or an Oldham's ring is supported by utilizing the upper end face of the large-diameter portion of the thrust ring, so that the construction of the thrust ring itself is complicated, which presents a problem of high manufacturing cost.

Also, since the thrust ring is configured so that a balancer is arranged on the inside, the diameter of a medium-diameter seal portion of the thrust ring increases inevitably. Further, since the large-diameter portion of thrust ring provided further on the outside of the medium-diameter seal portion is utilized as a means for regulating the moving distance in the axial direction of the thrust ring, the diameter of the thrust ring itself is large, so that the size and weight of the compressor increase inevitably.

SUMMARY OF THE INVENTION

The present invention has been made to solve the above-described problems, and accordingly an object thereof is to provide, at a low cost, a small-size and lightweight scroll compressor capable of preventing a decrease in compression efficiency by utilizing a medium pressure between a suction pressure and a discharge pressure as a back pressure.

To achieve the above object, the present invention has some features described below. In a scroll compressor in which the interior of a closed shell is partitioned into a refrigerant compression chamber including a fixed scroll and an orbiting scroll and a drive chamber including a motor with a main frame being held therebetween; a cylindrical thrust ring is arranged between the back surface of the end plate of the orbiting scroll and the main frame; and a first back pressure chamber into which a discharge pressure is introduced is provided on the inside of the thrust ring, the main frame is provided with a first inner peripheral surface with a smaller diameter and a second inner peripheral surface with a larger diameter, which are coaxial and have different diameters, and a height difference surface formed between the first inner peripheral surface and the second inner peripheral surface; the thrust ring has an inside diameter larger than the turning range of the eccentric shaft of the motor; there are provided first and second seal surfaces which are brought into close contact with the first and second inner peripheral surfaces, respectively, and an opposed surface which is arranged so as to be opposed to the height difference surface and forms an independent second back pressure chamber between the opposed surface and the height difference surface; and there is provided a pressure introducing means for introducing a medium pressure between a suction pressure and the discharge pressure into the second back pressure chamber.

According to this configuration, the main shaft of motor and an Oldham's ring are received by the main frame, whereby the orbiting scroll can surely be pressed against the fixed scroll side by a back pressure, and also the construction of the thrust ring can be simplified, so that the whole of the compressor can be made small in size, light in weight, and low in cost.

A sealing means for hermetically sealing the back pressure chambers is provided between the first and/or second inner peripheral surfaces of the main frame and the first and/or second seal surfaces of the thrust ring.

According to this configuration, by providing the sealing means between the seal surfaces, the back pressure chambers can surely be hermetically sealed, and the compressor can be manufactured at a lower cost because the engagement accuracy between the thrust ring and the main frame need not be increased.

The pressure introducing means consists of a medium pressure introduction hole, one end of which is open toward a closed working chamber in the refrigerant compression chamber and the other end of which is open toward the back surface of the end plate of the orbiting scroll, and a communication hole, one end of which is open toward the medium pressure introduction hole and the other end of which is open toward the second back pressure chamber; on a thrust surface formed on the upper end surface of the thrust ring, an annular concave groove is provided coaxially, and an inner ring and an outer ring are formed concentrically with the concave groove being held therebetween; and one end of the communication hole is open in the concave groove.

According to this configuration, the medium pressure can surely be introduced from the medium pressure introduction hole provided in the end plate of the orbiting scroll into the second back pressure chamber via the communication hole, and the medium pressure serving as a back pressure can be applied uniformly to the back surface of the end plate of the orbiting scroll.

The outside diameter of the inner ring is set on the inside of the outside diameter of the first seal surface of the thrust ring.

According to this configuration, an upward pressing force (back pressure) can surely be increased with respect to a repulsive force that pushes back the orbiting scroll to the downside, so that the orbiting scroll can be driven more steadily.

As a preferred mode, a regulating means for regulating the movable range in the axial direction of the thrust ring is provided. More favorably, the regulating means is formed by the height difference surface of the main frame and the opposed surface of the thrust ring. Also, the regulating means is formed by a flange portion having a diameter larger than that of the second seal surface of the thrust ring and a locking surface by which the flange portion of the main frame is locked. Further, a third inner peripheral surface having a diameter smaller than that of the first inner peripheral surface is provided, and the regulating means is formed by making the lower end surface of the thrust ring 8 abut on a second height difference surface formed between the first inner peripheral surface and the third inner peripheral surface.

According to these configurations, since the regulating means for regulating the movable range in the axial direction is provided between the thrust ring and the main frame, a gap between the end plate and the thrust surface does not become larger than necessary, so that the discharge pressure can be prevented from leaking out from the gap between the thrust surface and the end plate.

DETAILED DESCRIPTION

Figure 1:
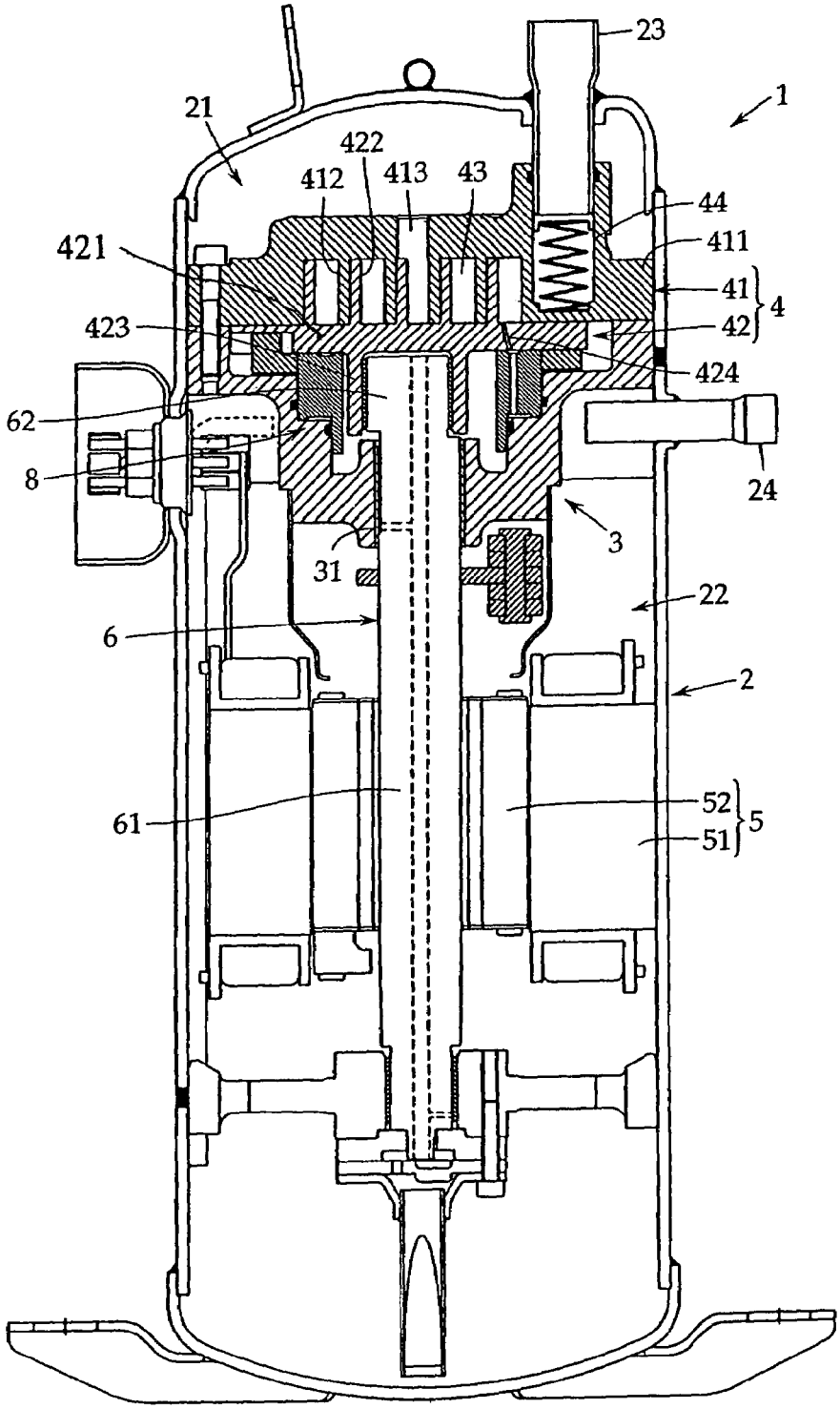
FIG. 1 is a sectional view of a scroll compressor in accordance with one embodiment of the present invention.
Figure 2:
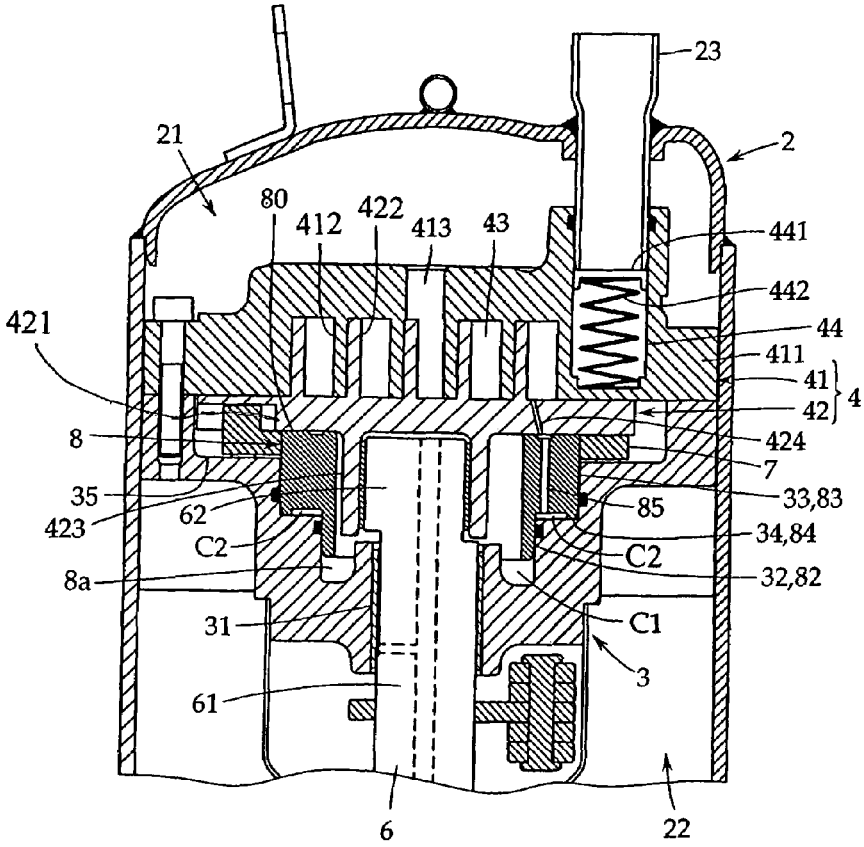
FIG. 2 is an enlarged sectional view of an essential portion of the scroll compressor shown in FIG. 1.

An embodiment of the present invention will now be described with reference to the accompanying drawings. The present invention is not limited to this embodiment. FIG. 1 is a sectional view of a scroll compressor in accordance with one embodiment of the present invention, and FIG. 2 is an enlarged view showing a compression section enlargedly.

This scroll compressor 1 consists of a cylindrical closed shell 2 placed vertically, and the interior thereof is partitioned into a compression chamber 21 and a motor chamber 22 with a main frame 3 being held therebetween. The closed shell 2 consists of a cylindrical shell portion and lid portions attached to the upper and lower ends of the shell portion, and these portions are integrated with each other by welding.

In this example, the scroll compressor 1 is what is called a high-pressure type scroll compressor in which a high-pressure refrigerant produced in the compression chamber 21 is drawn into the motor chamber 22 through a refrigerant passage (not shown) in the main frame 3, and then is delivered to a predetermined refrigeration cycle.

The compression chamber 21 is provided with a refrigerant compression section 4 consisting of a fixed scroll 41 and an orbiting scroll 42. In the motor chamber 22, a motor 5 for driving the orbiting scroll 42 via a rotary drive shaft 6 is provided.

The motor 5 is of an inner rotor type in which a rotor 52 is arranged coaxially in the center of a stator 51, and a main shaft 61 is attached coaxially to the rotor 52. At the tip end of the rotary drive shaft 6, an eccentric shaft 62 off-centered with respect to the axis line of the main shaft 61 is provided integrally. In the present invention, the specific configurations of the motor 5 and the rotary drive shaft 6 are arbitrary.

In the fixed scroll 41, a spiral scroll wrap 412 is integrally erected on the lower surface of a disc-shaped end plate 411. In the near-center of the fixed scroll 41, a discharge port 413 is provided to discharge a high-pressure refrigerant produced in the compression section 4.

In a side portion of a scroll wrap 412 in the fixed scroll 41, namely, in an outer peripheral portion of the wrap groove (the right-hand side portion in FIG. 2), a refrigerant suction hole 44 is formed, and a refrigerant suction pipe 23 for introducing a low-pressure refrigerant having finished work in the refrigeration cycle into a closed working chamber 43 is connected to the refrigerant suction hole 44.

Referring to FIG. 2, the refrigerant suction hole 44 consists of a bottomed vertical hole formed along the axial direction from the upper surface of the end plate 411 of the fixed scroll 41, and the side portion thereof communicates with the outer peripheral portion of the wrap groove of the compression chamber 43. The refrigerant suction hole 44 is provided with a check valve 441 for preventing a back flow of refrigerant and a compression spring 442 for pressing the check valve 441 against the upside at the stop time.

In the orbiting scroll 42, a spiral scroll wrap 422 is integrally formed on the upper surface of a disc-shaped end plate 421. In the center of the back surface of the end plate 421, a boss 423 in which the eccentric shaft 62 of the rotary drive shaft 6 is inserted is formed.

The orbiting scroll 42 is provided with a medium pressure introduction hole 424 one end of which is open to the closed working chamber 43 and the other end of which is open to the back surface of the end plate 421. The medium pressure introduction hole 424 is a through hole passing through the end plate 421 of the orbiting scroll 42, and is formed slantwise from the closed working chamber 43 side to the end plate back surface side.

The scroll wrap 412 of the fixed scroll 41 and the scroll wrap 422 of the orbiting scroll 42 are engaged with each other, by which the closed working chamber 43 for compressing a refrigerant is formed in the compression section 4.

As shown in FIG. 2, the main frame 3 is formed into a disc shape locked along the inner peripheral surface of the closed shell 2, and a main guide bearing 31 for pivotally supporting the main shaft 61 is provided in the center of the main frame 3. The main guide bearing 31 consists of a through hole formed coaxially in the center of the main frame 3, by which the main shaft 61 of the rotary drive shaft 6 is pivotally supported so as to be rotatable.

The upper surface of the main frame 3 is depressed from the upper surface of the main frame 3 toward the downside, and the interior of the depression is formed into a step shape including a first inner peripheral surface 32 with a smaller diameter and a second inner peripheral surface 33 with a larger diameter. Both of the first inner peripheral surface 32 and the second inner peripheral surface 33 are provided coaxially along the axial direction.

Between the first inner peripheral surface 32 and the second inner peripheral surface 33, a horizontal height difference surface 34 that forms a second back pressure chamber C2 between the height difference surface 34 and a thrust ring 8, described later, is provided. On the upper end side of the second inner peripheral surface 33, a locking surface 35 to which an Oldham's ring 7 for preventing the rotation is attached so as to be slidable along a predetermined direction is provided.

Figure 3A:
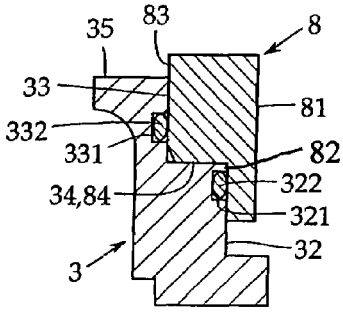
FIG. 3A is a partially enlarged sectional view of a seal construction using an O-ring.

Referring additionally to FIG. 3A, the first inner peripheral surface 32 has an inside diameter larger than the inside diameter of the main guide bearing 31, and is a vertical surface with which a first seal surface 82 of the thrust ring 8, described later, is brought into close contact. The first inner peripheral surface 32 is provided with an annular seal groove 321 along the inner peripheral surface thereof, and an O-ring 322 that comes into close contact with the first seal surface 82 is fitted in the seal groove 321.

The second inner peripheral surface 33 has an inside diameter larger than the inside diameter of the first inner peripheral surface 32, and is a vertical surface with which a second seal surface 83 of the thrust ring 8 is brought into close contact. The second inner peripheral surface 33 is also provided with an annular seal groove 331 along the inner peripheral surface thereof, and an O-ring 332 that comes into close contact with the second seal surface 83 is fitted in the seal groove 331.

Figure 3B:
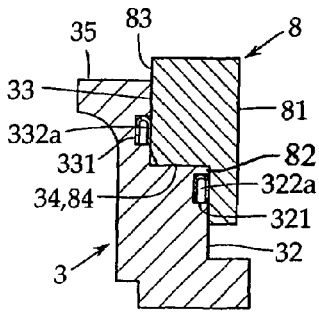
FIG. 3B is a partially enlarged sectional view of a seal construction using an elastic seal ring.

In this example, in the seal grooves 321 and 331, the O-rings 322 and 332 made of, for example rubber or resin are used. However, for example, as shown in FIG. 3B, elastic seal rings 322*a* and 332*a* having a U-shaped cross section may be used for sealing.

Figure 3C:
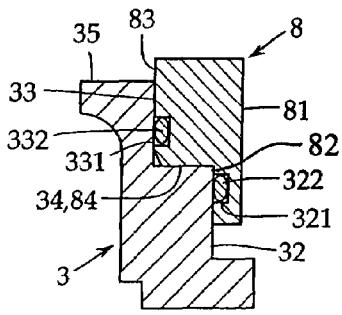
FIG. 3C is a partially enlarged sectional view showing a modification of a seal groove.

Also, in this example, the seal grooves 321 and 331 are provided on the main frame 3 side. However, as shown in FIG. 3C, these seal grooves may be provided on the thrust ring 8 side. The sealing means is not subjected to any special restriction if it can surely provide a seal between the first inner peripheral surface 32 and the first seal surface 82 and between the second inner peripheral surface 33 and the second seal surface 83.

Figure 4:
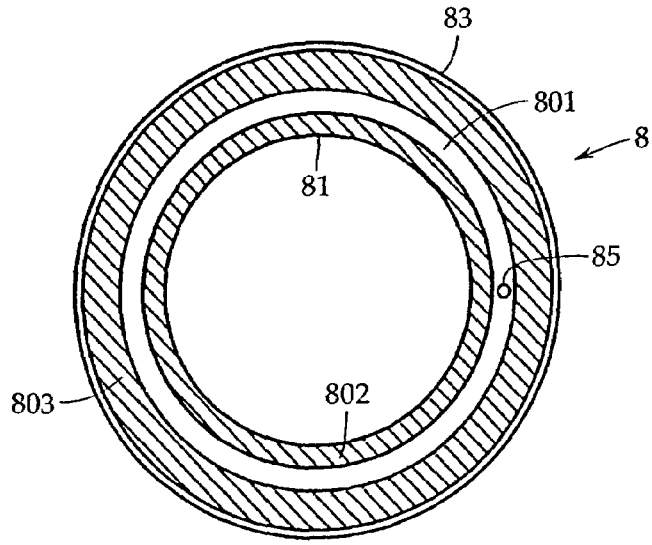
FIG. 4 is a transverse sectional view of a thrust ring.

Next, referring additionally to FIGS. 4 and 5, the thrust ring 8 consists of a cylindrical body whose inner periphery 81 has an inside diameter larger than the orbiting diameter of the boss 423 of the orbiting scroll 42, and a thrust surface 80 that comes into slidable contact with the back surface of the end plate 421 of the orbiting scroll 42 is provided at the upper end of the thrust ring 8. In this example, the inside diameter of the thrust ring 8 is formed so as to be larger than the orbiting diameter of the boss 423 of the orbiting scroll 42.

The thrust surface 80 consists of a highly accurate surface that comes into slidable contact with the back surface of the end plate 421 of the orbiting scroll 42, and an annular concave groove 801 is provided coaxially in a part of the thrust surface 80. The concave groove 801 communicates intermittently with the medium pressure introduction hole 424 in the rotation path of the medium pressure introduction hole 424 of the orbiting scroll 42, and plays a role in guiding the medium pressure into a communication hole 85, described later, in the thrust ring 8. The concave groove 801 also plays a role in distributing the pressure on the back surface of the orbiting roll 42 and the slidable contact surface of the thrust ring 8 uniformly.

The thrust surface 80 is formed with an inner ring 802 and an outer ring 803 concentrically with the concave groove 801 being held therebetween. The inner ring 802 is preferably configured so that the outside diameter D1 thereof is provided on the inside of the outside diameter D2 of a first seal surface, described later.

Figure 5A:
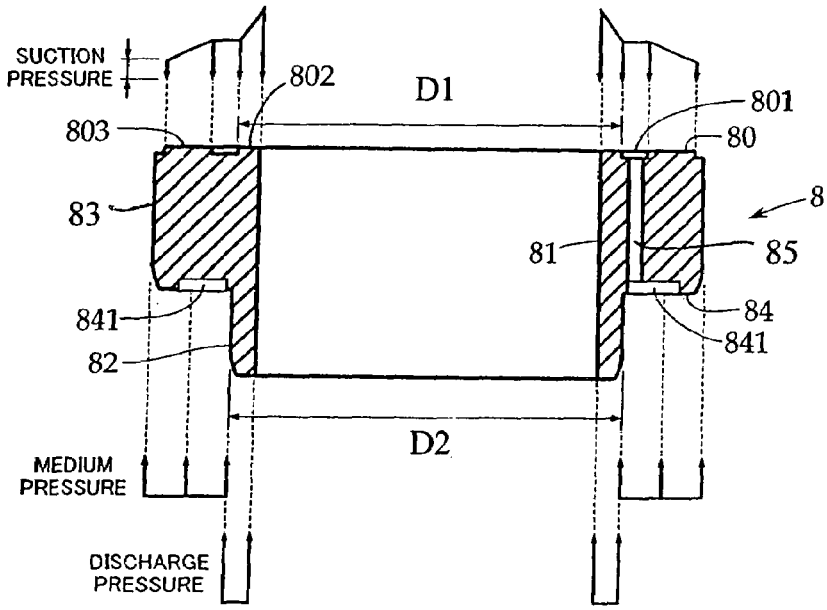
FIG. 5A is a central longitudinal sectional view of the thrust ring shown in FIG. 4.

According to this configuration, as shown in FIG. 5A, an upward (end plate direction) pressing force can surely be made higher than the pressing force (downward in FIG. 5A) acting on the orbiting scroll 42, so that the orbiting scroll 42 can be driven more steadily.

In FIG. 5A, a portion in which the pressure line is slantwise, namely, a portion in which a pressure gradient is present is a portion in which the upper end surface of the thrust ring is in slidable contact with the back surface of the orbiting scroll. In this slidable contact portion, a minute amount of refrigerant or lubricating oil leaks due to the influence of surface accuracy and surface roughness of both planes, by which the pressure gradient is produced.

In FIG. 5A, the pressure gradient is shown linearly for the sake of simplification. Actually, however, the pressure gradient is not linear depending on the surface accuracy and surface roughness of both planes. Further, in the case where there is scarcely a difference between the discharge pressure and the suction pressure, for example, at the starting time, the movement of the orbiting scroll is unsteady. That is to say, since the movement of the orbiting scroll deviates from the movement on the same plane, a state is formed in which the upper end surface of the thrust ring and the back surface of the orbiting scroll partially separate slightly from each other, so that the pressure distribution on the upper end surface of the thrust ring differs from the pressure distribution shown in FIG. 5A.

Figure 5B:
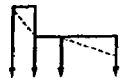
FIG. 5B is a pressure distribution diagram showing a maximum pressure applied to an upper end surface of the thrust ring shown in FIG. 4.

FIG. 5B shows a case where the sum of pressures applied to the upper end surface of the thrust ring is the greatest. As the case where the sum of pressures applied to the upper end surface of the thrust ring is the greatest, it is necessary to assume a case where the whole of a portion in which the pressure is shown slantwise in FIG. 5A has a pressure on the high pressure side. In this state as well, it is necessary to make configuration such that the sum of pressures that push up the thrust ring from the downside of the figure is superior.

According to this configuration, even in the case where the outside diameter of the inner ring is set so as to be smaller than the diameter of the seal surface, and hence the sum of pressures applied to the upper end surface of the thrust ring is the greatest, it is possible to make the sum of pressures that push up the thrust ring from the downside of the figure superior.

At the outer periphery of the thrust ring 8, a stepped surface consisting of a first seal surface 82 with a smaller diameter and the second seal surface 83 with a larger diameter, which are coaxial and have different diameters, is formed. Further, between the first seal surface 82 and the second seal surface 83, an opposed surface 84 is formed.

The first seal surface 82 is formed on the lower end side of the thrust ring 8, and forms a small-diameter seal surface capable of being inserted along the first inner peripheral surface 32 of the main frame 3. On the tip end side (the lower end side in FIG. 5A) of the first seal surface 82, a taper portion is provided so as to facilitate the insertion along the first inner peripheral surface 32 of the main frame 3.

The second seal surface 83 is formed on the upper end side of the thrust ring 8, and forms a large-diameter seal surface capable of being inserted along the second inner peripheral surface 33 of the main frame 3. On the lower end side of the second seal surface 83 as well, a taper portion is formed.

The opposed surface 84 consists of a horizontal plane parallel with the height difference surface 34, and one end of the communication hole 85, described later, is open in the opposed surface 84.

In the thrust ring 8, the communication hole 85 penetrating in the axial direction is provided. As shown in FIG. 5A, the communication hole 85 is configured so that the upper end thereof is open toward the concave groove 801 in the thrust surface 80, and the lower end thereof is open toward the opposed surface 84.

Referring again to FIG. 2, by attaching the thrust ring 8 along the first inner peripheral surface 32 and the second inner peripheral surface 33 of the main frame 3, a first back pressure chamber C1 is formed on the inside of the thrust ring 8.

The first back pressure chamber C1 communicates with the motor chamber 22 via the main guide bearing 31 of the main frame 3, and a space of discharge pressure is formed by the high-pressure refrigerant discharged into the motor chamber 22. Thereby, a back pressure consisting of a discharge pressure component is applied to the lower end surface of the thrust ring 8.

Between the height difference surface 34 of the main frame 3 and the opposed surface 84 of the thrust ring 8, an independent and hermetically sealed second back pressure chamber C2 is formed. The second back pressure chamber C2 communicates with the closed working chamber 43 via the communication hole 85 in the thrust ring 8 and the medium pressure introduction hole 424 in the orbiting scroll 42 so that the medium pressure produced in the closed working chamber 43 is drawn into the second back pressure chamber C2.

According to this configuration, the back pressure consisting of the discharge pressure component (high pressure) in the first back pressure chamber C1 is applied to the center side of the thrust ring 8, and the back pressure consisting of the medium pressure component in the second back pressure chamber C2 is applied so as to surround the outer periphery of the thrust ring 8, by which the back surface of the end plate 421 of the orbiting scroll 42 can be pressed uniformly.

Figure 6:
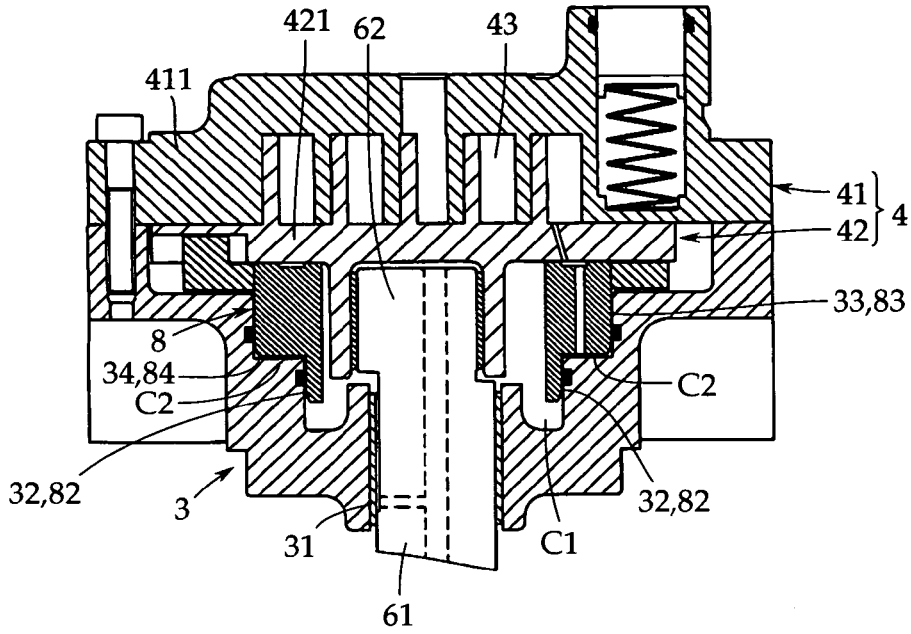
FIG. 6 is an enlarged sectional view of an essential portion, for illustrating a first regulating means.

A regulating means for regulating the movable range in the axial direction of the thrust ring 8 is explained with reference to FIGS. 6 to 9. As shown in FIG. 6, between the height difference surface 34 of the main frame 3 and the opposed surface 84 of the thrust ring 8, a minute gap is formed to regulate the movable range in the axial direction of the thrust ring 8.

The minute gap means a gap which is located under the thrust ring 8, and is such that a gap is produced in a portion providing a slidable seal between the upper surface of the thrust ring 8 and the back surface of the orbiting scroll 42, and in the case where gas leakage from the inside high-pressure section to the outside low-pressure section occurs, the leakage amount is smaller than the circulating flow rate as a compressor, presenting no problem in generating a predetermined pressure difference. In a general compressor for an air conditioner, this minute gap is not larger than 0.1 mm.

Thereby, even if the thrust ring 8 moves downward and a gap is produced between the upper surface of the thrust ring 8 and the back surface of the end plate of the orbiting scroll 42, a pressure difference is produced between the discharge side and the suction side by the starting of the compressor 1, so that the thrust ring 8 is raised by the pressure difference. Therefore, the thrust ring 8 and the orbiting scroll 42 are brought into slidable contact with each other normally, so that the leakage of gas is prevented, and hence the decrease in compression efficiency can be prevented.

Figure 7:
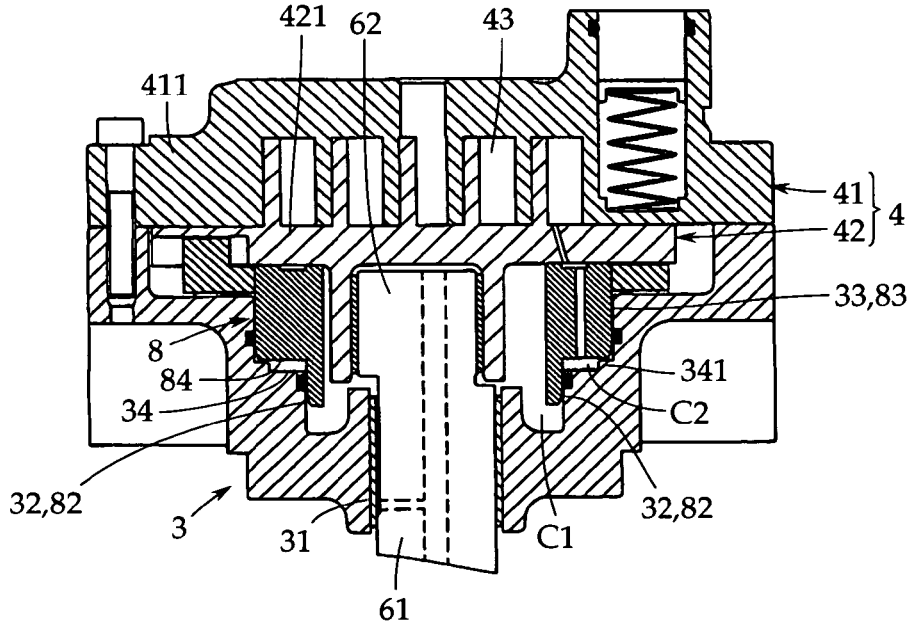
FIG. 7 is an enlarged sectional view of an essential portion, for illustrating a second regulating means.

As another mode, as shown in FIG. 7, the configuration may be such that a convex portion 341 is provided in a part of the height difference surface 34 of the main frame 3, and the opposed surface 84 of the thrust ring 8 is made to abut on the convex portion 341, by which a minute gap is formed.

Figure 8:
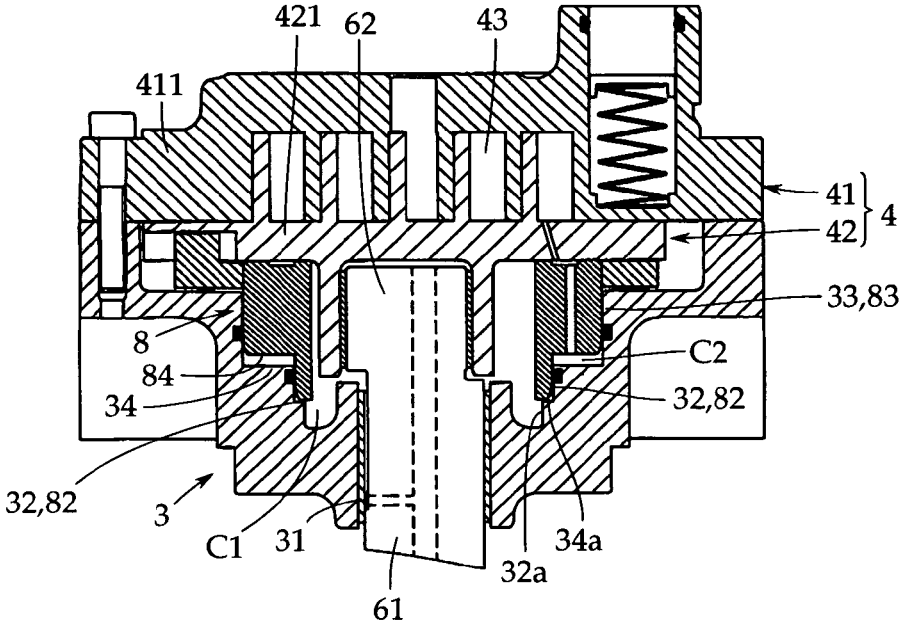
FIG. 8 is an enlarged sectional view of an essential portion, for illustrating a third regulating means.

Also, as shown in FIG. 8, a third inner peripheral surface 32*a* having a diameter smaller than that of the first inner peripheral surface 32 of the main frame 3 is provided, and a second height difference surface 34*a* is formed therebetween so that the lower end surface of the thrust ring 8 is received by the second height difference surface 34*a*. By this configuration as well, the movable range in the axial direction of the thrust ring 8 is regulated, and thus a minute gap can be formed between the lower end surface of the thrust ring and the second height difference surface 34*a*.

Figure 9:
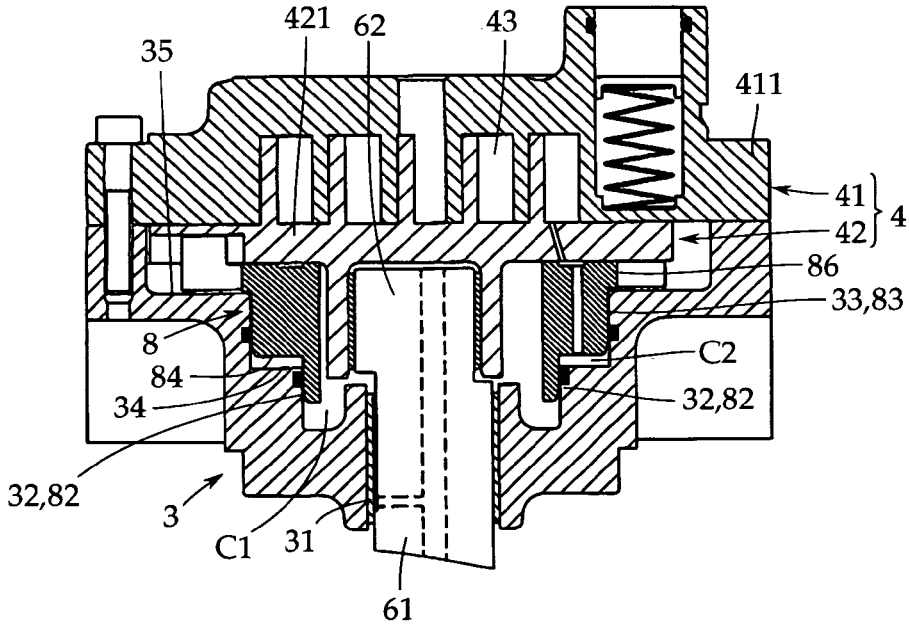
FIG. 9 is an enlarged sectional view of an essential portion, for illustrating a fourth regulating means.

Further, as shown in FIG. 9, a flange portion 86 having a diameter larger than that of the second inner peripheral surface 33 (the second seal surface 83) is provided coaxially at the upper end of the thrust ring 8, and the flange portion 86 may be used as a regulating means.

Specifically, the upper end surface of this flange portion 86 is used as a part of the thrust surface 80, and the lower end surface thereof is locked along the locking surface 35 of the main frame 3. The flange portion 86 preferably has a length such that a minute gap is formed between the upper end surface of the flange portion 86 and the back surface of the orbiting scroll 42 to let the thermal deformation and pressure deformation at the time of operation escape when the axial length of the flange portion 86 locks along the locking surface 35.

Figure 10:
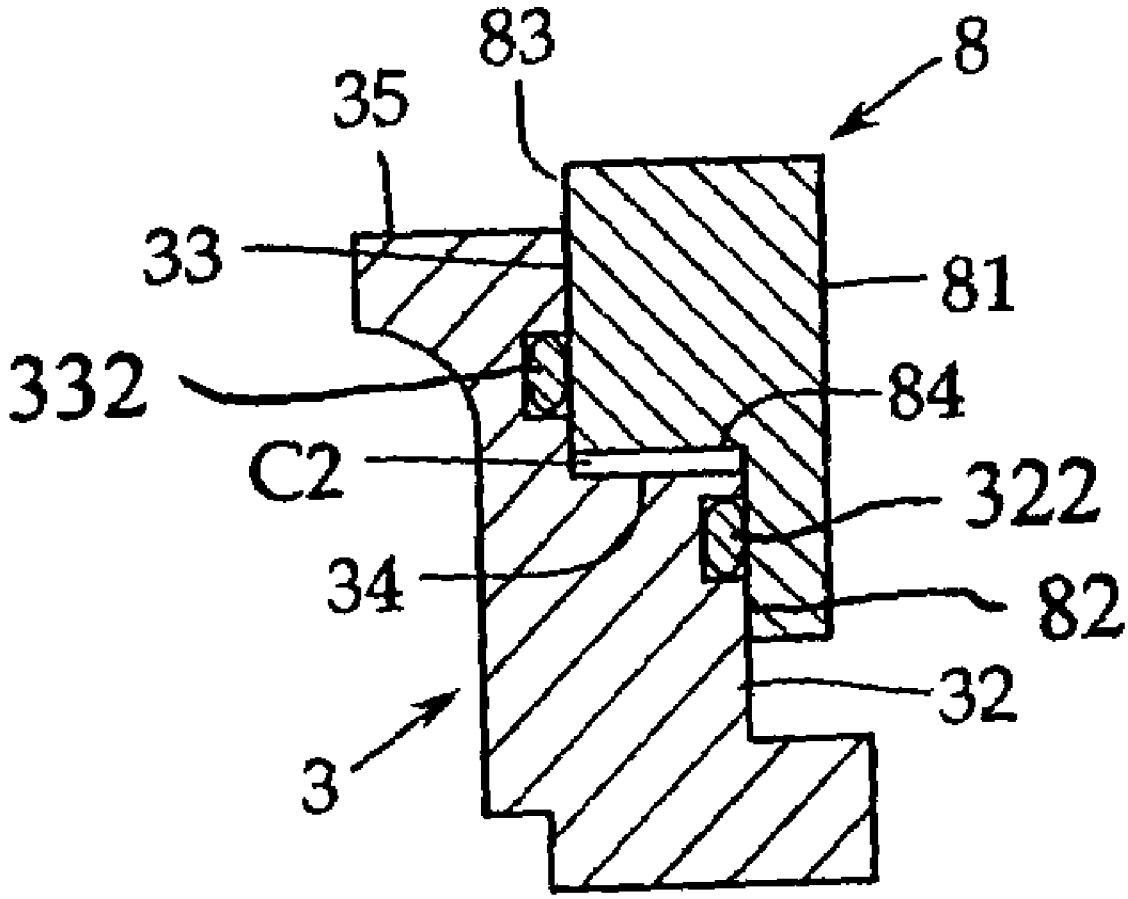
FIG. 10 is a schematic view showing a state in which a thrust ring is raised.

Although a minute gap is provided in the above-described embodiment, a larger gap may be provided. The reason for this is that, as shown schematically in FIG. 10, by the first driving after the assembly of the compressor 1, the thrust ring 8 is raised by the pressure difference, and if it is raised once, the thrust ring 8 is supported by the elastic sealing materials 322 and 332 even after the stopping to prevent the thrust ring 8 from dropping. That is to say, if the elastic sealing material 322 has a function of always pressing the thrust ring 8 against the back surface of the orbiting scroll 42, there is no need for controlling the gap so as to be minute.

When this scroll compressor 1 is operated, the high-pressure refrigerant discharged from the closed working chamber 43 into the compression chamber 21 is carried to a space above the motor 5 in the motor chamber 22 through the refrigerant passage (not shown) provided in a part of each of the fixed scroll 41 and the main frame 3. The high-pressure refrigerant carried into the motor chamber 22 is delivered to the refrigerant cycle through a refrigerant discharge pipe 24.

Some of the high-pressure refrigerant carried into the motor chamber 22 is introduced into the first back pressure chamber C1 via the main guide bearing 31, by which the atmosphere in the first back pressure chamber C1 is turned into a discharge pressure atmosphere, and thus a back pressure consisting of the discharge pressure is applied to the lower end surface of the thrust ring 8.

The low-pressure refrigerant introduced into the closed working chamber 43 is gradually compressed from the outside toward the center. The medium pressure between the suction pressure and the discharge pressure passes through the medium pressure introduction hole 424 formed in the end plate 421 of the orbiting scroll 42, and is carried to the back surface of the end plate 421. Thereafter, the medium pressure is introduced into the second back pressure chamber C2 through the communication hole 85. Thereby, the atmosphere in the second back pressure chamber C2 is turned into a medium pressure atmosphere, and thus a back pressure consisting of the medium pressure is applied to the opposed surface 84.

In this embodiment, as the scroll compressor 1, a high-pressure type scroll compressor in which a high-pressure refrigerant is led to the motor chamber 22 and then is discharged to the outside of the compressor has been described as an example. However, besides this configuration, the main frame 3 and the thrust ring 8 in accordance with the present invention may be applied to a low-pressure type scroll compressor to form the second back pressure chamber C2, and a pressure introducing means for introducing the discharge pressure or the medium pressure into the second back pressure chamber C2 may be formed.

The present application is based on, and claims priority from, Japanese Applications Serial Number JP2005-147700, filed May 20, 2005, the disclosure of which is hereby incorporated by reference herein in its entirety.

The invention claimed is:

1. A scroll compressor comprising a closed shell partitioned into a refrigerant compression chamber including a fixed scroll and an orbiting scroll and a drive chamber including a motor with a main frame held therebetween; a cylindrical thrust ring arranged between a back surface of an end plate of the orbiting scroll and the main frame; and a first back pressure chamber into which a discharge pressure is introduced on an inside of the thrust ring, wherein the main frame is provided with a first inner peripheral surface with a smaller diameter, a second inner peripheral surface with a larger diameter, and a third inner peripheral surface having a diameter smaller than that of the first inner peripheral surface, which are coaxial and have different diameters, a first height difference surface formed between the first inner peripheral surface and the second inner peripheral surface, and a second height difference surface formed between the first inner peripheral surface and the third inner peripheral surface; and the thrust ring has an inside diameter larger than a turning range of an eccentric shaft of the motor, first and second seal surfaces which are brought into close contact with the first and second inner peripheral surfaces, respectively, and an opposed surface which is arranged so as to be opposed to the first height difference surface and forms an independent second back pressure chamber between the opposed surface and the first height difference surface;

said scroll compressor further comprising pressure introducing means for introducing a medium pressure between a suction pressure and the discharge pressure into the second back pressure chamber, and regulating means for regulating movement of the thrust ring, formed by making a lower end surface of the thrust ring abut on the second height difference surface.

2. The scroll compressor according to claim 1, wherein the pressure introducing means comprises a medium pressure introduction hole, one end of which is open toward a closed working chamber in the refrigerant compression chamber and the other end of which is open toward the back surface of the end plate of the orbiting scroll, and a communication hole, one end of which is open toward the medium pressure introduction hole and the other end of which is open toward the second back pressure chamber; on a thrust surface formed on an upper end surface of the thrust ring, an annular concave groove is provided coaxially, and an inner ring and an outer ring are formed concentrically with the concave groove being held therebetween; and one end of the communication hole is open in the concave groove.

3. The scroll compressor according to claim 2, wherein an outside diameter of the inner ring is set on an inside of an outside diameter of the first seal surface of the thrust ring.

* * * * *